US010008155B2

(12) United States Patent
Byun et al.

(10) Patent No.: US 10,008,155 B2
(45) Date of Patent: Jun. 26, 2018

(54) GATE DRIVING CIRCUIT AND ORGANIC LIGHT EMITTING DISPLAY DEVICE INCLUDING THE SAME

(71) Applicants: ELECTRONICS AND TELECOMMUNICATIONS RESEARCH INSTITUTE, Daejeon (KR); University-Industry Cooperation Group of Kyung Hee Univ, Yongin (KR)

(72) Inventors: Chunwon Byun, Daejeon (KR); Jong-Heon Yang, Daejeon (KR); Sung-Min Yoon, Suwon (KR); Kyoung Ik Cho, Daejeon (KR); Chi-Sun Hwang, Daejeon (KR)

(73) Assignees: ELECTRONICS AND TELECOMMUNICATIONS RESEARCH INSTITUTE, Daejeon (KR); UNIVERSITY-INDUSTRY COOPERATION GROUP OF KYUNG HEE UNIV, Yongin (KR)

( * ) Notice: Subject to any disclaimer, the term of this patent is extended or adjusted under 35 U.S.C. 154(b) by 93 days.

(21) Appl. No.: 15/220,713

(22) Filed: Jul. 27, 2016

(65) Prior Publication Data

US 2017/0032741 A1 Feb. 2, 2017

(30) Foreign Application Priority Data

Jul. 28, 2015 (KR) ..... 10-2015-0106747
Mar. 4, 2016 (KR) ..... 10-2016-0026258

(51) Int. Cl.
*G09G 3/12* (2006.01)
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0842* (2013.01);
(Continued)

(58) Field of Classification Search
CPC .. G09G 3/12; G09G 3/14; G09G 3/30–3/3291
See application file for complete search history.

(56) References Cited

U.S. PATENT DOCUMENTS 6,411,545 B1 6/2002 Caywood
2002/0024054 A1 * 2/2002 Koyama ..... G09G 3/3266 257/84

(Continued)

OTHER PUBLICATIONS

Kyeong-Ah Kim et al., "Read-Out Modulation Scheme for the Display Driving Circuits Composed of Nonvolatile Ferroelectric Memory and Oxide-Semiconductor Thin-Film Transistors for Low-Power Consumption", IEEE Transactions on Electron Devices, 2015, pp. 394-401, vol. 63, No. 1, IEEE.

*Primary Examiner* — Sanghyuk Park

(57) ABSTRACT

Provided is a gate driving circuit. The gate driving circuit includes an ith modulation circuit and an ith line selection circuit (where i is a natural number greater than 1). The ith modulation circuit outputs an ith modulation voltage to an ith line selection circuit based on received first to third control signals. The ith line selection circuit includes a memory transistor that is turned on or turned off according to a level of the received ith modulation voltage.

20 Claims, 10 Drawing Sheets

(52) U.S. Cl.
CPC ..... *G09G 2300/0861* (2013.01); *G09G 2310/0286* (2013.01); *G09G 2310/0289* (2013.01); *G09G 2310/0291* (2013.01); *G09G 2330/021* (2013.01); *G09G 2330/028* (2013.01)

(56) References Cited

U.S. PATENT DOCUMENTS

| | | | | |
|---|---|---|---|---|
| 2005/0007315 | A1 | 1/2005 | Yang et al. | |
| 2011/0249044 | A1* | 10/2011 | Ebisuno ..... | G09G 3/3233 345/690 |
| 2013/0050175 | A1* | 2/2013 | Wu ..... | G09G 3/3225 345/212 |
| 2013/0088285 | A1 | 4/2013 | Pi et al. | |

* cited by examiner

GATE DRIVING CIRCUIT AND ORGANIC LIGHT EMITTING DISPLAY DEVICE INCLUDING THE SAME

CROSS-REFERENCE TO RELATED APPLICATIONS

This U.S. non-provisional patent application claims priority under 35 U.S.C. § 119 of Korean Patent Application Nos. 10-2015-0106747, filed on Jul. 28, 2015, and 10-2016-0026258, filed on Mar. 4, 2016, the entire contents of which are hereby incorporated by reference.

BACKGROUND

The present disclosure herein relates to an organic light emitting display device, and more particularly, to a gate driving circuit having improved integration and less power consumption and an organic light emitting display device including the same.

Various display devices used for multi media devices such as televisions, mobile phones, tablet computers, navigations, and game consoles are being developed. There is an Organic Light Emitting Display (OLED) device as one type of such a display device. An OLED device, as a self-luminous display device, has a wide viewing angle, excellent contrast, and fast response speed.

An OLED device includes a plurality of pixels. Each of the plurality of pixels includes an organic light emitting diode and a circuit unit for controlling the same. The circuit unit includes at least a switching transistor, a driving transistor, and a storage capacitor. The organic light emitting diode includes an anode, a cathode, and an organic light emitting layer disposed between the anode and the cathode. The organic light emitting diode emits light when a voltage greater than a threshold voltage is applied to the organic light emitting layer between the anode and the cathode.

SUMMARY

The present disclosure provides a gate driving circuit for increasing the degree of integration and consuming less power and an OLED device including the same.

An embodiment of the inventive concept provides a gate driving circuit. The gate driving circuit includes an ith modulation circuit and an ith line selection circuit (where i is a natural number greater than 1). The ith modulation circuit outputs an ith modulation voltage to an ith line selection circuit based on received first to third control signals. The ith line selection circuit includes a memory transistor that is turned on or turned off according to a level of the received ith modulation voltage.

In an embodiment of the inventive concept, an organic light emitting display device includes a gate driving circuit, a data driving circuit, and organic light emitting display panels. The gate driving circuit provides gate signals to gate lines and provides light emitting control signals to light emitting lines. Also, the gate driving circuit includes an ith modulation circuit connected to an i−1th gate line and an i+1th gate line (where i is a natural number greater than 1) and an ith line selection circuit connected to an ith gate line and an ith light emitting line. The ith modulation circuit outputs an ith modulation voltage to the ith line selection circuit based on received first to third control signals and the ith line selection circuit includes a memory transistor that is turned on or turned off according to a level of the received ith modulation voltage. The data driving circuit provides data signals to data lines. The organic light emitting display panels include a plurality of pixels.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

The above-mentioned characteristics and following detailed descriptions are all exemplary details to help describing and understanding the inventive concept. That is, the inventive concept may be embodied in different forms without limited to such embodiments. The following embodiments are merely illustrative for fully disclosing the inventive concept, and described for delivering the inventive concept to those skilled in the art. Accordingly, if there are several methods for implementing components of the inventive concept, it should be clarified that it is possible to implement the inventive concept through a specific one among those methods or any one of methods having the identity thereto.

If there is a mention that a certain configuration includes specific elements or a certain process includes specific steps, it means that other elements or other steps may be further included. That is, the terms used herein are merely intended to describe particular embodiments, and are not intended to limit the inventive concept. Furthermore, examples described to help understanding the inventive concept include their complementary embodiments.

The terms used herein have meanings that those skilled in the art commonly understand. The commonly-used terms should be construed as a consistent meaning in the context of the specification. Additionally, unless clearly defined, the terms used herein should not be construed as excessively ideal or formal meanings. Hereinafter, embodiments of the inventive concept are described with reference to the accompanying drawings.

Figure 1:
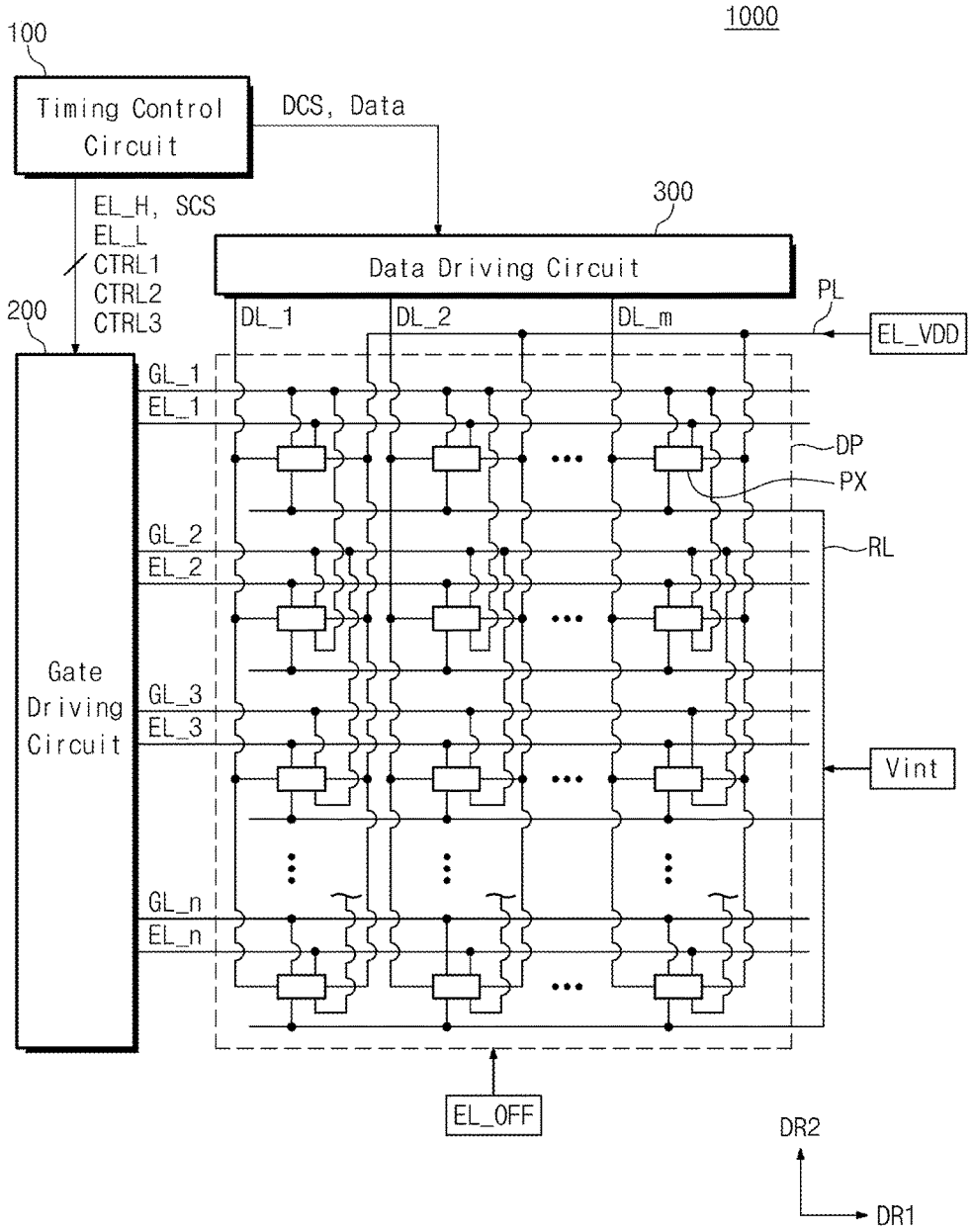
FIG. 1 is a block diagram illustrating an Organic Light Emitting Display (OLED) device according to an embodiment of the inventive concept.

FIG. 1 is a block diagram illustrating an Organic Light Emitting Display (OLED) device according to an embodiment of the inventive concept. Referring to FIG. 1, an OLED device 1000 includes a timing control circuit 100, a gate driving circuit 200, a data driving circuit 300, and an OLED panel DP.

The timing control circuit 100 receives input image signals (not shown). Then, based on the received input image signals (not shown), the timing control circuit 100 may convert the data format of the input image signals to match the interface specification of the data driving circuit 300 and generate image data Data. Then, the timing control circuit 100 may output the image data Data, various control signals DCS, CTRL_1, CTRL_2, and CTRL_3, and first and second power voltages EL_H and EL_L.

Then, the gate driving circuit 200 may receive a gate control signal SCS, the first to third control signals CTRL_1, CTRL_2, and CTRL_3, and the first and second power voltages EL_H and EL_L, from the timing control circuit 100. The gate control signal SCS may include a vertical start signal for stating an operation of the gate driving circuit 200 and a clock signal for determining the output timings of signals. The gate driving circuit 200 may generate a plurality of gate signals and sequentially output the plurality of gate signals to a plurality of gate lines GL1 to GLn described later.

Additionally, the gate driving circuit 200 may generate a plurality of light emitting control signals based on the gate control signal SCS, the first to third control signals CTRL_1, CTRL_2, and CTRL_3, and the first and second power voltages EL_H and EL_L. Then, the gate driving circuit 200 outputs a plurality of light emitting control signals to a plurality of light emitting lines EL1 to ELn described later.

FIG. 1 illustrates that a plurality of gate signals and a plurality of light emitting control signals are outputted from one gate driving circuit 200 but an embodiment of the inventive concept is not limited thereto. According to an embodiment of the inventive concept, a plurality of gate driving circuits may divide and output a plurality of gate signals and also may divide and output a plurality of light emitting control signals. Additionally, according to an embodiment of the inventive concept, a driving circuit for generating and outputting a plurality of gate signals and a driving circuit for generating and outputting a plurality of light emitting control signals may be separately divided.

The data driving circuit 300 receives the data control signal DCS and the image data Data from the timing control circuit 100. The data driving circuit 300 converts the image data Data to data signals, and outputs the data signals to a plurality of data lines DL1 to DLm described later. The data signals are analog voltages corresponding to a grayscale value of the image data Data.

The OLED panel DP may include a plurality of gate lines GL1 to GLn, a plurality of light emitting lines EL1 to ELn, a plurality of data lines DL1 to DLm, and a plurality of pixels PX. The plurality of gate lines GL1 to GLn extend in a first direction DR1 and are arranged in a second direction DR2 vertical to the first direction DR1. Each of the plurality of light emitting lines EL1 to ELn may be arranged parallel to a corresponding gate line among the plurality of gate lines GL1 to GLn. The plurality of data lines DL1 to DLm intersect the plurality of gate lines GL1 to GLn insulatingly.

Each of the plurality of pixels PX is connected to a corresponding gate line among the plurality of gate lines GL1 to GLn, a corresponding light emitting line among the plurality of light emitting lines EL1 to ELn, and a corresponding data line among the plurality of data lines DL1 to DLm. Each of the plurality of pixels PX receives a first pixel voltage EL_VDD and a second pixel voltage EL_VSS having a lower level than the first pixel voltage EL_VDD. Each of the plurality of pixels PX is connected to a power line PL where the first pixel voltage EL_VDD is applied. Each of the plurality of pixels PX is connected to an initialization line RL for receiving an initialization voltage Vint. Although briefly shown in FIG. 1, each of the plurality of pixels PX may be connected to a plurality of gate lines among the plurality of gate lines GL1 to GLn.

According to an embodiment of the inventive concept, light emitting signals applied to light emitting lines may be generated based on gate signals applied to gate lines. Accordingly, according to an embodiment of the inventive concept, it is possible to block the power for an unnecessary portion and reduce clocking power. That is, in comparison to the case of using a conventional technique for generating gate signals by using a plurality of clocks, the number of clocks necessary for a circuit operation is reduced and thus power consumption is reduced. Additionally, since the number of elements used for generating clocks is reduced, it is advantageous in terms of the miniaturization of a device area.

Figure 2:
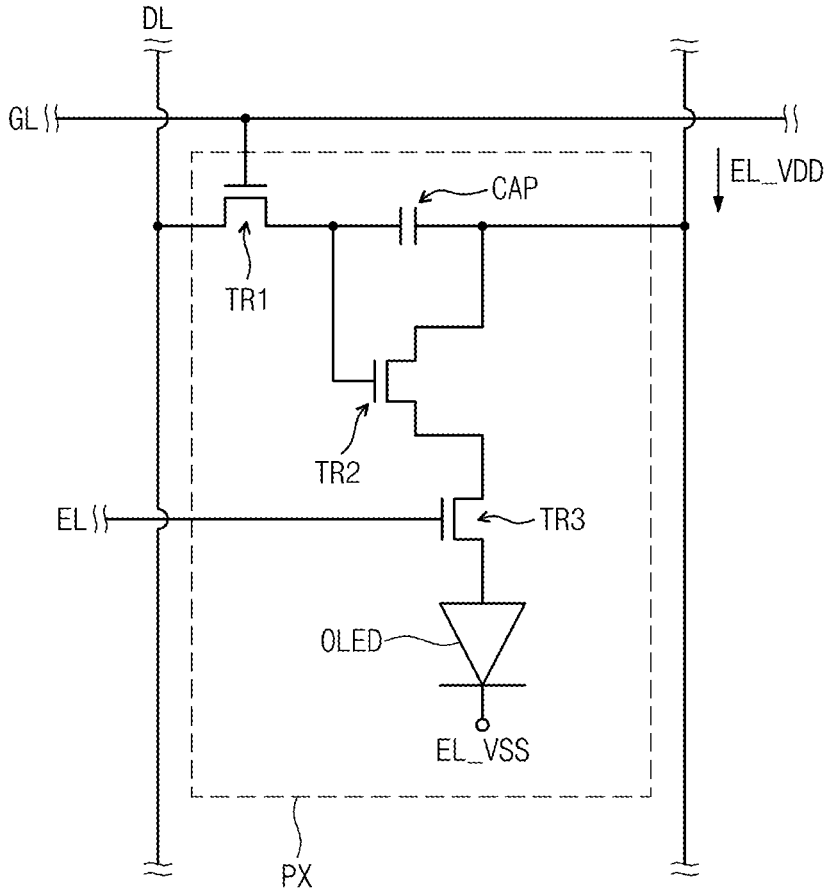
FIG. 2 is an equivalent circuit of a pixel included in an OLED panel according to an embodiment of the inventive concept.

FIG. 2 is a view illustrating an equivalent circuit of a pixel included in an OGLED panel according to an embodiment of the inventive concept. Referring to FIG. 2, pixels PX include an organic light emitting device OLED and a circuit unit for controlling the organic light emitting device OLED.

The circuit unit may include a first transistor TR1, a second transistor TR2, a third transistor TR3, and a capacitor CAP.

The first transistor TR1 includes a first control electrode, a first input electrode, and a first output electrode. For example, the first control electrode is connected to a gate line GL. For example, the first input electrode is connected to a data line DL. For example, the first output electrode is connected to a first electrode of the capacitor CAP and a control electrode of the second transistor TR2, which are described later.

The capacitor CAP includes a first electrode connected to a first output electrode of the first transistor TR1 and a second electrode for receiving a first pixel voltage EL_VDD. The capacitor CAP charges a voltage corresponding to a data signal received from the first transistor TR1.

The second transistor TR2 includes a second control electrode, a second input electrode, and a second output electrode. For example, the second control electrode is connected to the first output electrode of the first transistor TR1. For example, the second input electrode receives a first pixel voltage EL_VDD. For example, the second output electrode is connected to a third input electrode of the third transistor TR3.

The third transistor TR2 includes a third control electrode, a third input electrode, and a third output electrode. For example, the third control electrode is connected to a light emitting line EL to receive a plurality of light emitting control signals. For example, the third input electrode is connected to a second output electrode of the second transistor TR2. For example, the third output electrode is connected to the organic light emitting device OLED. The third transistor TR3 performs an on/off operation in response to a light emitting control signal received through the light emitting line EL. Accordingly, the third transistor TR3 may perform a control to allow a current corresponding to a voltage stored in the capacitor CAP to flow toward the organic light emitting device OLED.

The organic light emitting device OLED includes an anode connected to the output electrode of the third transistor TR3 to receive a first pixel voltage EL_VDD and a cathode for receiving a second pixel voltage EL_VSS. Additionally, the organic light emitting device OLED includes a light emitting layer disposed between the anode and the cathode. The organic light emitting device OGLED may emit light during a turn-on section of the third transistor TR3.

According to an embodiment of the inventive concept, light emitting signals applied to light emitting lines may be generated based on gate signals applied to gate lines. Exemplarily, when a gate signal is a high-level signal, a light emitting signal may be a low-level signal. On the other hand, when a gate signal is a low-level signal, a light emitting signal may be a high-level signal. Moreover, the equivalent circuit of the pixels PX is not limited to FIG. 2 and may be modified and implemented.

Figure 3:
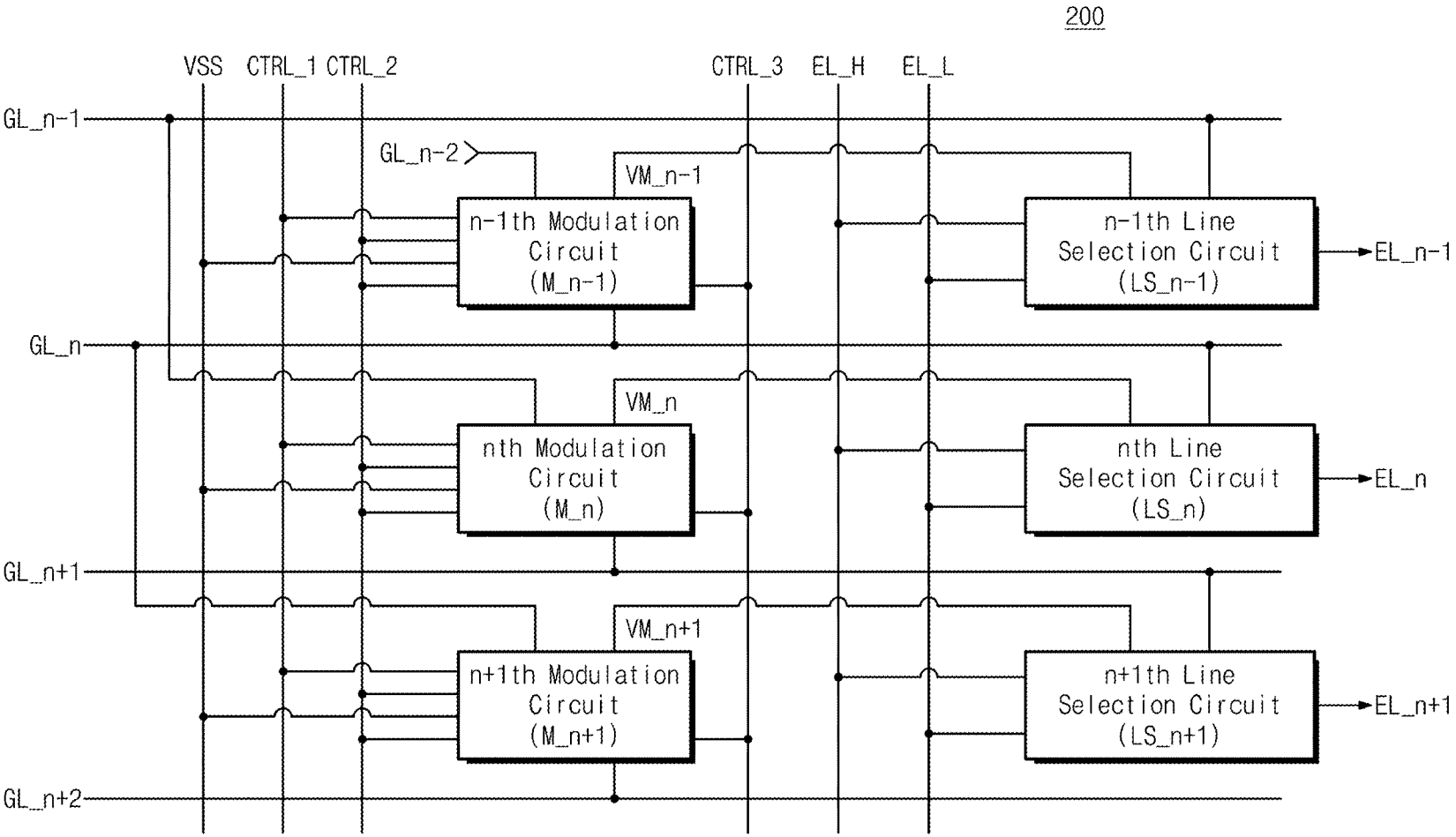
FIG. 3 is a block diagram illustrating a gate driving circuit according to an embodiment of the inventive concept.

FIG. 3 is a block diagram illustrating a gate driving circuit according to an embodiment of the inventive concept. Referring to FIGS. 1 to 3, a gate driving circuit 200 includes a plurality of modulation circuits M_n−1, M_n, and M_n+1 that respectively correspond to a plurality of gate lines GL_n−1, GL_n, and GL_n+1 and a plurality of line selection circuits LS_n−1, LS_n, and LS_n+1 (n is a natural number greater than 2).

Each of the plurality of modulation circuits M_n−1, M_n, and M_n+1 shown in FIG. 3 may be connected to one gate line. For example, the n−1th modulation circuit M_n−1 is connected to the n−2th gate line GL_n−2. For example, the nth modulation circuit M_n is connected to the n−1th gate line GL_n−1. The n+1th modulation circuit M_n+1 is connected to the nth control line GL_n.

Each of the plurality of modulation circuits M_n−1, M_n, and M_n+1 shown in FIG. 3 may be connected to a ground voltage VSS. Exemplarily, the ground voltage VSS may be used when voltages of the plurality of modulation circuits M_n−1, M_n, and M_n+1 are initialized.

Each of the plurality of modulation circuits M_n−1, M_n, and M_n+1 receives first to third control signals CTRL1, CTRL2, and CTRL3 from the timing control circuit 100. Each of the plurality of modulation circuits M_n−1, M_n, and M_n+1 may output a plurality of modulation voltages VM_n−1, VM_n, and VM_n+1 based on the first to third control signals CTRL1, CTRL2, and CTRL3. For example, the n−1th modulation circuit M_n−1 outputs the n−1th modulation voltage VM_n−1 based on the first to third control signals CTRL1, CTRL2, and CTRL3. For example, the nth modulation circuit M_n outputs the nth modulation voltage VM_n based on the first to third control signals CTRL1, CTRL2, and CTRL3. For example, the n+1th modulation circuit M_n+1 outputs the n+1th modulation voltage VM_n+1 based on the first to third control signals CTRL1, CTRL2, and CTRL3. The first to third control signals CTRL1, CTRL2, and CTRL3 are described in more detail with reference to the accompanying drawings.

The plurality of line selection circuits LS_n−1, LS_n, and LS_n+1 may be respectively connected to the plurality of modulation circuits M_n−1, M_n, and M_n+1. For example, the n−1th line selection circuit LS_n−1 may be connected to the n−1th modulation circuit M_n−1 to receive the n−1th modulation voltage VM_n−1. For example, the nth line selection circuit LS_n may be connected to the nth modulation circuit M_n to receive the nth modulation voltage VM_n. For example, the n+1th line selection circuit LS_n+1 may be connected to the n+1th modulation circuit M_n+1 to receive the n+1th modulation voltage VM_n+1.

Each of the plurality of line selection circuits LS_n−1, LS_n, and LS_n+1 may be connected to the first power voltage EL_H and the second power voltage EL_L received from the timing control circuit 100. Then, the plurality of line selection circuits LS_n−1, LS_n, and LS_n+1 may be respectively connected to the corresponding gate lines GL_n−1, GL_n, and GL_n+1. For example, the n−1th line selection circuit LS_n−1 is connected to the n−1th gate line GL_n−1. For example, the nth line selection circuit LS_n is connected to the nth gate line GL_n. For example, the n+1th line selection circuit LS_n+1 is connected to the n+1th gate line GL_n+1.

Additionally, each of the plurality of line selection circuits LS_n−1, LS_n, and LS_n+1 may select the first power voltage EL_H or the second power voltage EL_L based on the received modulation voltages VM_n−1, VM_n, and VM_n+1 and gate signals GL_n−1, GL_n, and GL_n+1, and output it as the plurality of light emitting control signals EL_n−1, EL_n, and EL_n+1.

Figure 4:
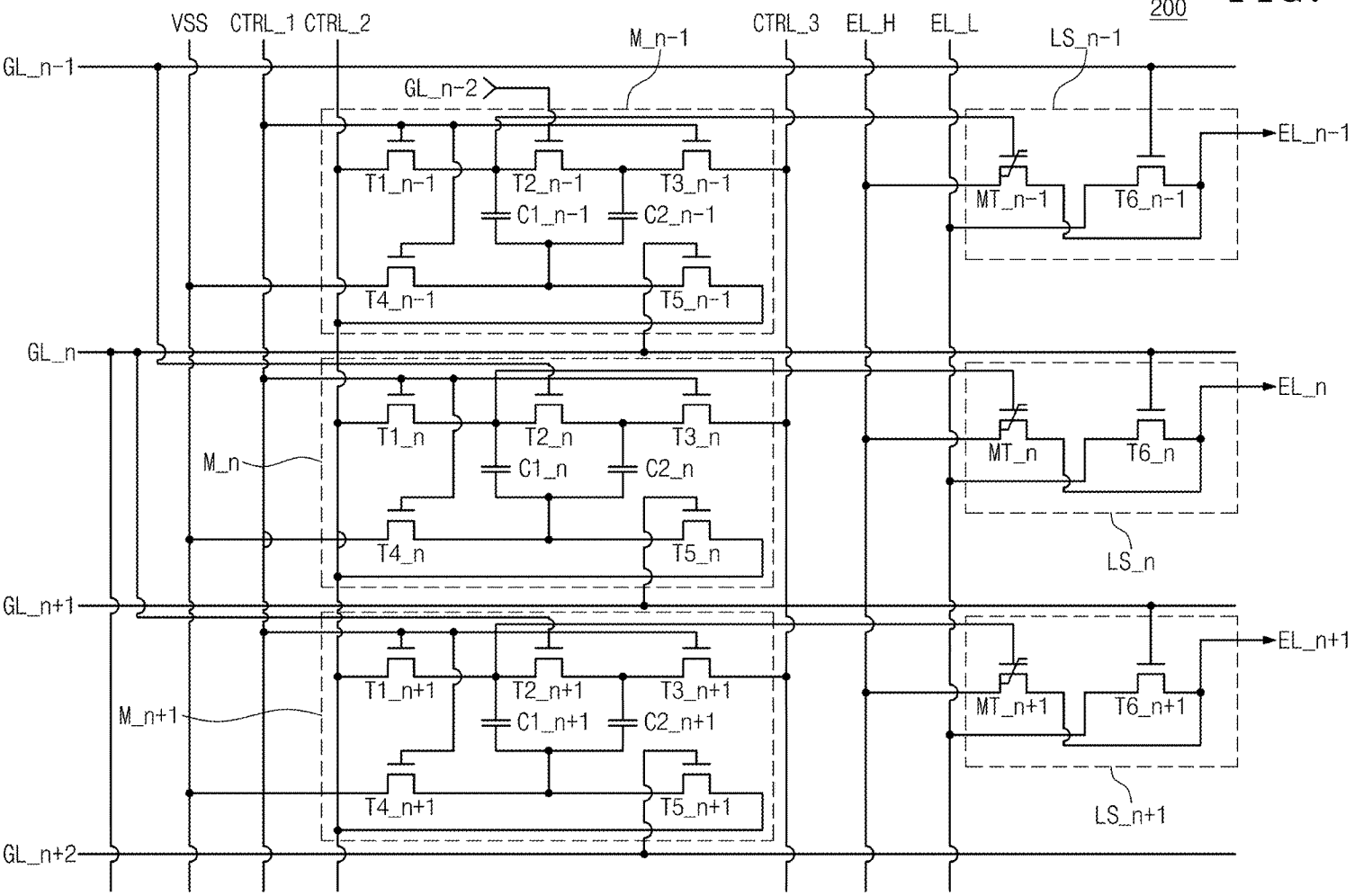
FIG. 4 is a circuit diagram illustrating a gate driving circuit in more detail according to an embodiment of the inventive concept.

FIG. 4 is a circuit diagram illustrating a gate driving circuit in more detail according to an embodiment of the inventive concept. Referring to FIGS. 1 to 4, each of a plurality of modulation circuits M_n−1, M_n, and M_n+1 includes five transistors and two capacitors.

For example, the n−1th modulation circuit M_n−1 includes first to fifth transistors T1_*n*−1 to T5_*n*−1 and first and second capacitors C1_*n*−1 and C2_*n*−1. The nth modulation circuit M_n includes first to fifth transistors T1_*n* to T5_*n* and first and second capacitors C1_*n* and C2_*n*. The n+1th modulation circuit M_n+1 includes first to fifth transistors T1_*n*+1 to T5_*n*+1 and first and second capacitors C1_*n*+1 and C2_*n*+1.

Then, each of a plurality of line selection circuits LS_n−1, LS_n, and LS_n+1 may include one memory transistor and one transistor. For example, the n−1th line selection circuit LS_n−1 includes an n−1th memory transistor MT_n−1 and a sixth transistor T6_*n*−1. For example, the nth line selection circuit LS_n includes an nth memory transistor MT_n and a sixth transistor T6_*n*. For example, the n+1th line selection circuit LS_n+1 includes an n+1th memory transistor MT_n+1 and a sixth transistor T6_*n*+1.

For brief description, an internal structure of the nth modulation circuit M_n and an internal structure of the nth line selection circuit LS_n are described mainly.

The nth modulation circuit M_n of FIG. 4 includes the first to fifth transistors T1_*n* to T5_*n* and the first and second capacitors C1_*n* and C2_*n*. For example, the first to fifth transistors T1_*n* to T5_*n* may be Oxide Thin Film Transistors (OTFTs). The OTFTs may have a very small size of off current in comparison to a general thin film transistor. Accordingly, when the OTFTs are used, power consumption due to off current may be reduced. Alternatively, when the OTFTs are used, the malfunction of a device due to off current is reduced so that its reliability may be improved.

The control electrode of the first transistor T1_*n* receives a first control signal CTRL_1. Accordingly, when the first control signal CTRL_1 is in a high level, the first transistor T1_*n* is turned on. Then, the input electrode of the first transistor T1_*n* receives a second control signal CTRL_2. Then, the output electrode of the first transistor T1_*n* is connected to the input electrode of the second transistor T2_*n* and the first capacitor C1_*n*.

The control electrode of the second transistor T2_*n* is connected to the n−1th gate line GL_n−1. Accordingly, when a gate signal of the n−1th gate line GL_n−1 is in a high level, the second transistor T2_*n* is turned on. Then, the input electrode of the second transistor T2_*n* is connected to the output electrode of the first transistor T1_n and the first capacitor C1_n. Then, the output electrode of the second transistor T2_n is connected to the input electrode of the third transistor T3_n and the second capacitor C2_n.

The control electrode of the third transistor T3_n receives the first control signal CTRL_1. Accordingly, when the first control signal CTRL_1 is in a high level, the third transistor T3_n is turned on. Then, the input electrode of the third transistor T3_n receives the third control signal CTRL_3. Then, the output electrode of the third transistor T3_n is connected to the output electrode of the second transistor T2_n and the second capacitor C2_n.

The control electrode of the fourth transistor T4_n receives the first control signal CTRL_1. Accordingly, when the first control signal CTRL_1 is in a high level, the fourth transistor T4_n is turned on. Then, the input electrode of the fourth transistor T4_n receives a ground voltage signal VSS. Then, the output electrode of the fourth transistor T4_n is connected to the output electrode of the fifth transistor T5_n, the first capacitor C1_n, and the second capacitor C2_n.

The control electrode of the fifth transistor T5_n is connected to the n+1th gate line GL_n+1. Accordingly, when a gate signal of the n+1th gate line GL_n+1 is in a high level, the fifth transistor T5_n corresponding to the nth gate line GL_n is turned on. Then, the input electrode of the fifth transistor T5_n receives a second control signal CTRL_2. Then, the output electrode of the fifth transistor T5_n is connected to the output electrode of the fourth transistor T4_n, the first capacitor C1_n, and the second capacitor C2_n.

A first node N1_n may be an intersection point of the output electrode of the first transistor T1_n and the input electrode of the second transistor T2_n. A second node N2_n may be an intersection point of the output electrode of the second transistor T2_n and the output electrode of the third transistor T3_n. A third node N3_n may be an intersection point of the output electrode of the fourth transistor T4_n and the output electrode of the fifth transistor T5_n.

The first capacitor C1_n is connected between the first node N1_n and the third node N3_n. The second capacitor C2_n is connected between the second node N2_n and the third node N3_n. Additionally, the size of a capacitance C1 of the first capacitor C1_n may be smaller than the size of a capacitance C2 of the second capacitor C2_n. When the size of a capacitance C2 of the second capacitor C2_n is great, a change amount in voltage stored in the first capacitor C1_n may be great. Through this, the accuracy of a turn-on operation and a turn-off operation in a memory transistor described later may be improved.

The nth line selection circuit LS_n includes a memory transistor MT_n and a sixth transistor T6_n.

The memory transistor MT_n is a nonvolatile device for maintaining programmed data characteristics regardless of power. The control electrode of the memory transistor MT_n is connected to the first node N1_n. The operating characteristics of the memory transistor MT_n are determined according to whether it is programmed and a level of voltage applied to the first node N1_n. The operating characteristics of the memory transistor MT_n are described in more detail with reference to the drawings described later. The input electrode of the memory transistor MT_n receives a first power voltage EL_H. The output electrode of the memory transistor MT_n is connected to the nth light emitting line EL_n.

The sixth transistor T6_n may be an OTFT. As mentioned above, the OTFT may have a very small size of off current. Accordingly, when the OTFT is used, power consumption may be reduced and the reliability of a device may be obtained. The control electrode of the sixth transistor T6_n is connected to the nth gate line GL_n. Accordingly, when a gate signal of the nth gate line GL_n is in a high level, the sixth transistor T6_n corresponding to the nth gate line GL_n is turned on. The input electrode of the sixth transistor T6_n receives a second power voltage EL_L. The output electrode of the sixth transistor T6_n is connected to the nth light emitting line EL_n.

Until now, an internal structure of the nth modulation circuit M_n and an internal structure of the nth line selection circuit LS_n corresponding to the nth gate line GL_n of FIG. 4 are described. Based on the description above, an internal structure of the n−1th modulation circuit M_n−1 and an internal structure of the n−1th line selection circuit LS_n−1 corresponding to the n−1th gate line GL_n−1 shown in FIG. 4 and an internal structure of the n+1th modulation circuit M_n+1 and an internal structure of the n+1th line selection circuit LS_n+1 corresponding to the n+1th gate line GL_n+1 may be understood.

Figure 5:
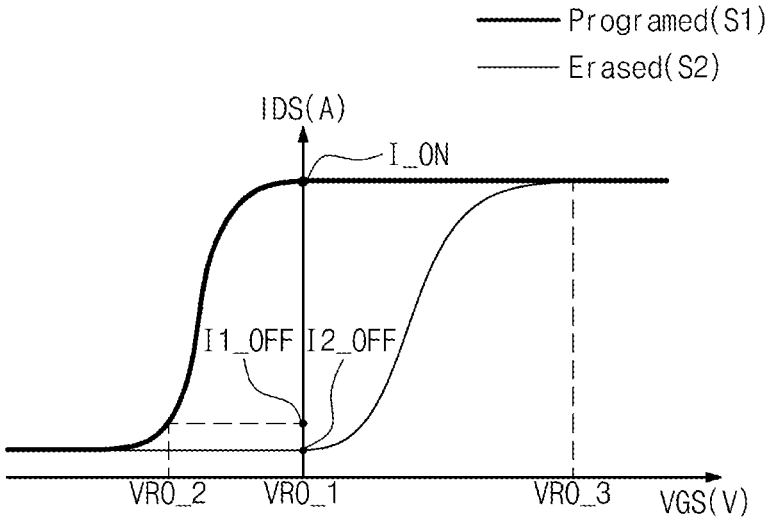
FIG. 5 is a view illustrating the operating characteristics of a memory transistor.

FIG. 5 is a view illustrating the operating characteristics of a memory transistor. Referring to FIGS. 4 and 5, a memory transistor MT may have one of a program state or an erase state. The horizontal axis of FIG. 5 represents the size of a gate voltage VGS applied to the control electrode of the memory transistor MT, and the vertical axis of FIG. 5 represents the size of a drain current IDS flowing through the channel of the memory transistor MT.

A state of the programmed memory transistor MT may indicate a first state S1. For example, when a first read voltage VRO_1 is applied as a gate voltage VGS of the memory transistor MT, the drain current IDS of the memory transistor MT in the first state S1 may be a turn-on current I_ON. Additionally, when a second read voltage VRO_2 is applied as the gate voltage VGS of the memory transistor MT, the drain current IDS of the memory transistor MT in the first state S1 may be a first turn-off current I1_OFF. Then, when a third read voltage VRO_3 is applied as the gate voltage VGS of the memory transistor MT, the drain current IDS of the memory transistor MT in the first state S1 may be a turn-on current I_ON.

Additionally, a state of the erased memory transistor MT may indicate a second state S2. For example, when the first read voltage VRO_1 is applied as the gate voltage VGS of the memory transistor MT, the drain current IDS of the memory transistor MT in the second state S2 may be a second turn-off current I2_OFF. In the same manner, when the second read voltage VRO_2 is applied as the gate voltage VGS of the memory transistor MT, the drain current IDS of the memory transistor MT in the second state S2 may be a second turn-off current I2_OFF. Then, when the third read voltage VRO_3 is applied as the gate voltage VGS of the memory transistor MT, the drain current IDS of the memory transistor MT in the second state S2 may be a turn-on current I_ON.

Although it is expressed in FIG. 5 that the first turn-off current I1_OFF and the second turn-off current I2_OFF have different current levels, this is exemplary and it should be understood that the inventive concept further includes various embodiments that the first turn-off current I1_OFF and the second turn-off current I2_OFF have the same current level.

According to an embodiment of the inventive concept in which the memory transistor MT is integrated on a gate driving circuit, the size of a drain current in the memory transistor MT having the same state (for example, a program sate or an erase state) may be adjusted by dynamically adjusting the size of a read voltage. Exemplarily, when the first read voltage VRO_1 is applied as the gate voltage VGS of the memory transistor MT in the first state S1, the drain current IDS may be a turn-on current I_ON. In this case, the size of the turn-on current I_ON is 10^7 times greater than the size of the first turn-off current I1_OFF and the second turn-off current I2_OFF.

On the other hand, when the second read voltage VRO_2 obtained by modulating the voltage size of the first read voltage VRO_1 is applied as the gate voltage VGS of the memory transistor MT in the first state S1, the drain current IDS may flow as the first turn-off current I1_OFF. In this case, since the size of the first turn-off current I1_OFF is 10^7 times less than the size of the turn-on current I_ON, the memory transistor MT in the first state S1 is turned off by the second read voltage VRO_2. According to an embodiment of the inventive concept, as shown in FIG. 5, a level of the first read voltage VRO_1 may be modulated to a level of the second read voltage VRO_2 or a level of the second read voltage VRO_2 may be modulated to a level of the first read voltage VRO_1.

The inventive concept may perform a turn-on or turn-off operation of the memory transistor MT based on a size difference of a drain current according to the modulation of a read voltage level applied to the gate of the memory transistor MT. That is, when an existing predetermined voltage level of gate voltage VGS is applied, a program operation or an erase operation is not required to distinguish a turn-on or turn-off operation of the memory transistor MT. Accordingly, an additional program time or an erase time required for a program operation or an erase operation for distinguishing a turn-on or turn-off operation of the existing memory transistor MT is not required.

Therefore, this inventive concept is applied to an operating environment that requires a fast operation (for example, an operation for switching from turn-on to turn-off or turn-off to turn-on) of the memory transistor MT.

Figure 6:
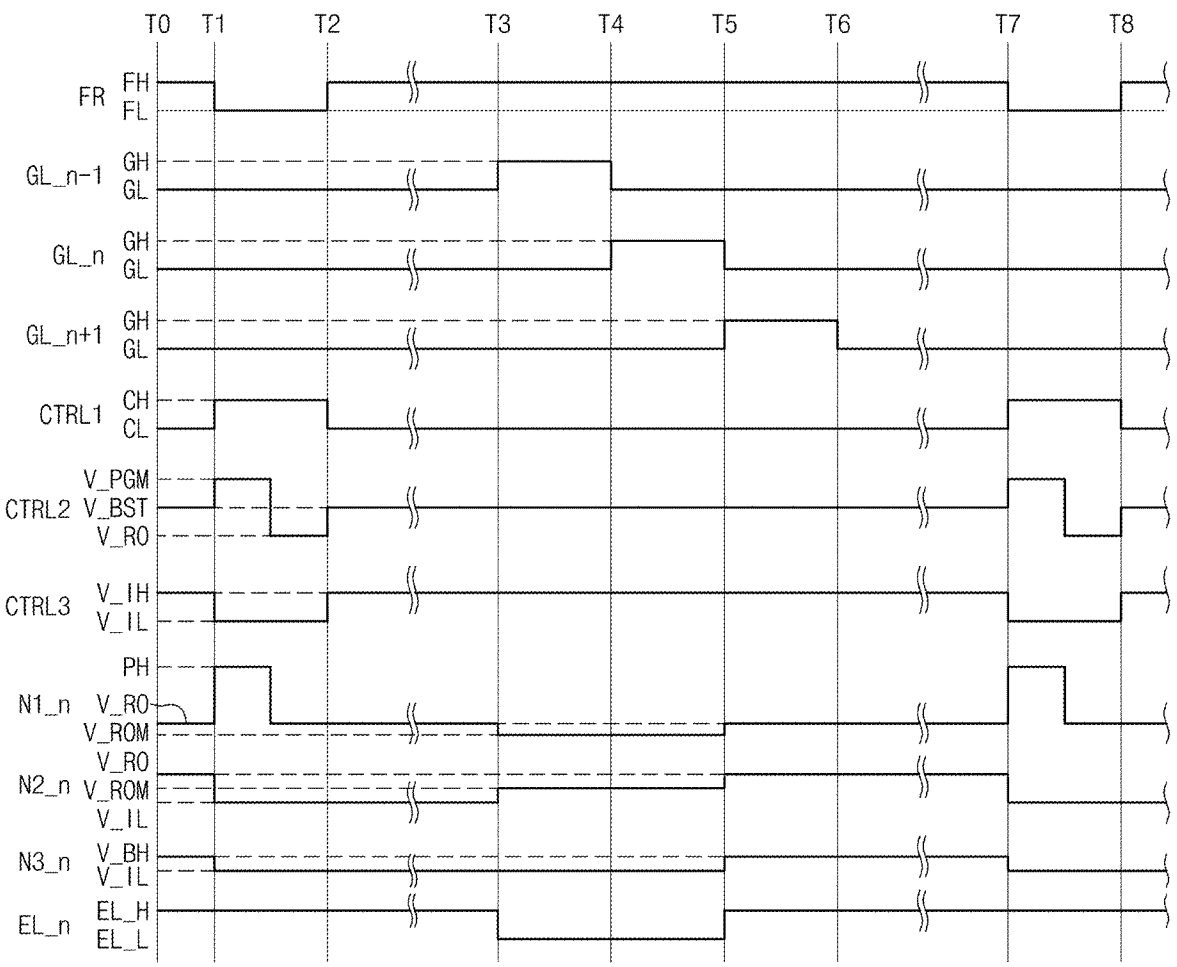
FIG. 6 is a timing diagram illustrating an operation of a driving circuit according to an embodiment of the inventive concept.

FIG. 6 is a timing diagram illustrating an operation of a gate driving circuit according to an embodiment of the inventive concept. Referring to FIGS. 1 to 6, it is assumed that a driving circuit according to an embodiment of the inventive concept includes a plurality of gate lines GL_n−1, GL_n, and GL_n+1 and a plurality of light emitting control lines EL_n−1, EL_n, and EL_n+1.

The horizontal axis of FIG. 6 is a time and configured with a first section T0 to T1 to an eighth section T7 to T8. Then, the vertical axes mean levels of corresponding signals. Exemplarily, one frame may include the second to seventh sections T2 to T7. FIG. 6 illustrates an operation of a gate driving circuit in one frame and it may be understood that redundant description for the next frame is omitted.

For reference, the first section T0 to T1 of FIG. 6 may indicate a section where a gate signal of the last gate line (not shown) of a previous frame has a high level. The third section T2 to T3 of FIG. 6 may mean a section where a gate signal having a high level of the n−2th gate line GL_n−2 (not shown) is applied from a gate signal having a high level of the first gate line GL_1 (not shown). Furthermore, The seventh section T6 to T7 of FIG. 6 may mean a section where a gate signal having a high level of the last gate line (not shown) is applied from a gate signal having a high level of the n+2th gate line GL_n+2 (not shown).

A frame signal FR of FIG. 6 is in a high level FH in the first section T0 to T1. The frame signal FR is in a low level FL in the second section T1 to T2. As described later, a program operation is performed on the plurality of memory transistors MT in the first section T0 to T1 where the frame signal FR has a low level FL. That is, while gate signals having a high level are applied sequentially from the first gate line GL_1 to the nth gate line GL_n, the frame signal FR maintains a high level FH. Then, the frame signal FR of FIG. 6 has a high level FH in the remaining sections T2 to T7 in one frame.

The n−1th gate line GL_n−1 of FIG. 6 has a high level GH in the fourth section T3 to T4, and has a low level GL in the remaining sections in one frame T1 to T7.

The nth gate line GL_n of FIG. 6 has a high level GH in the fifth section T4 to T5, and has a low level GL in the remaining sections in one frame T1 to T7.

The n+1th gate line GL_n+1 of FIG. 6 has a high level GH in the sixth section T5 to T6, and has a low level GL in the remaining sections in one frame T1 to T7.

A first control signal CTRL_1 of FIG. 6 may be a signal having a high level CH only in a section (for example, the second section T1 to T2) where the plurality of gate lines GL_n−1, GL_n, and GL_n+1 are all in low levels and having a low level CL in the remaining sections in one frame T1 to T7.

A second control signal CTRL_2 of FIG. 6 has a level of a boost voltage V_BST after rising to a level of a program voltage V_PGM for programming a memory transistor MT described later in the second section T1 to T2 and dropping to a level of a read-out voltage V_RO for turning on the memory transistor MT. Then, the second control signal CTRL_2 maintains a level of the boost voltage V_BST in the remaining sections T2 to T7 in one frame T1 to T7.

A third control signal CTRL_3 of FIG. 6 has a low level V_IL in the second section T1 to T2, and has a high level V_IH in the remaining sections in one frame T1 to T7. In more detail, a voltage level of the third control signal CTRL_3 in the second section T1 to T2 may charge a capacitor described later in a negative voltage level.

It is assumed that a first node N1_*n*, a second node N2_*n*, a third node N3_*n*, and an nth light emitting line EL_n of FIG. 6 correspond to an nth gate line GL_n. A voltage level of the first node N1_*n* of FIG. 6 rises to a level of the program voltage V_PGM for programming a memory transistor MT described later in the second section T1 to T2 and drops to a level of the read-out voltage V_RO for turning on the memory transistor MT. Then, a voltage level of the first node N1_*n* may maintain a level of the read-out voltage V_RO for the third section T2 to T3. Then, a voltage level of the first node N1_*n* may maintain a level of a modulation voltage V_RoM for the fourth section T3 to T4 and the fifth section T4 to T5. Then, a voltage level of the first node N1_*n* may maintain a level of the read-out voltage V_RO for the sixth section T5 to T6 and the seventh section T6 to T7.

A voltage level of the second node N2_*n* of FIG. 6 drops to a low level V_IL according to the control signal CRT_3 in the second section T1 to T2. The low level V_IL means a negative voltage level. Then, a voltage level of the second node N2_*n* may maintain the low level V_IL for the third section T2 to T3. Then, a voltage level of the second node N2_*n* may maintain a level of the modulation voltage V_RoM for the fourth section T3 to T4 and the fifth section T4 to T5. Then, a voltage level of the second node N2_*n* may maintain a level of the read-out voltage V_RO for the sixth section T5 to T6 and the seventh section T6 to T7.

A voltage level of the third node N3_*n* of FIG. 6 maintains the low level V_BL for the second section T1 to T2 to the fifth section T4 to T5. Then, a voltage level of the third node N3_*n* may maintain the high level V_BH for the sixth section T5 to T6 and the seventh section T6 to T7.

The nth light emitting line EL_n of FIG. 6 may output a first power voltage EL_H for the first section T0 to T1 to the third section T2 to T3. Then, the nth light emitting line EL_n outputs a second power voltage EL_L for the fourth section T3 to T4 and the fifth section T4 to T5. Then, the nth light emitting line EL_n outputs the first power voltage EL_H for the sixth section T5 to T6 and the seventh section T6 to T7.

Figure 7:
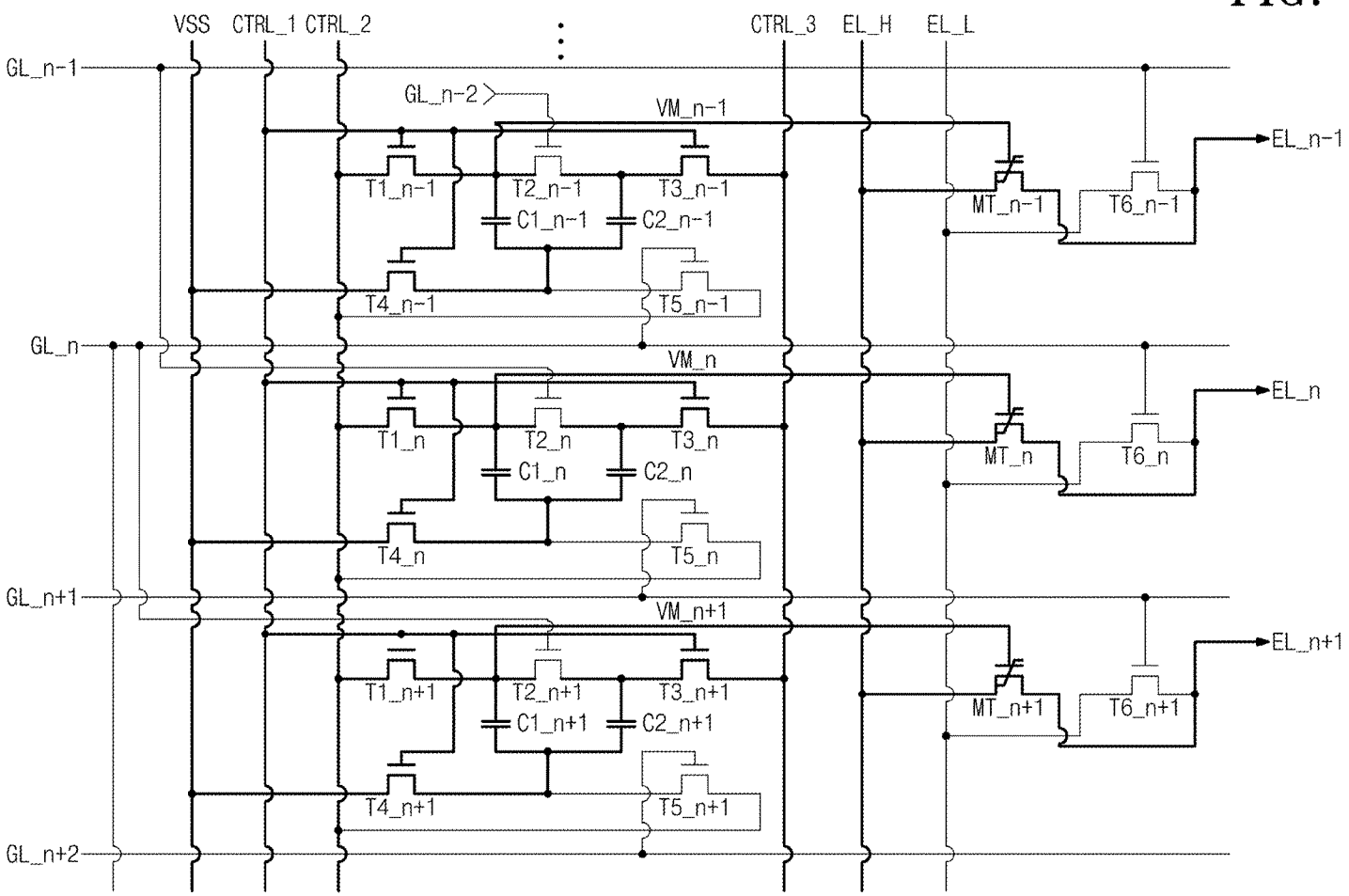
FIG. 7 is a circuit diagram illustrating an operation of a gate driving circuit in a section T1 to T2 of FIG. 6.

FIG. 7 is a circuit diagram illustrating an operation of a gate driving circuit in the second section T1 to T2 of FIG. 6. Referring to FIGS. 1 to 7, the second section T1 to T2 is a section where the frame signal FR is in the low level FL and gate signals of the plurality of gate lines GL_n−1, GL_n, and GL_n+1 configuring one frame are all in the low level CL. When the second section T1 to T2 of FIG. 7 is described, lines indicated by the solid line represent that signals in high level are applied. Additionally, devices displayed by the solid line represent devices activated in the second section T1 to T2.

In the second section T1 to T2, the first control signal CTRL_1 has the high level CH. Accordingly, the first transistor T1_*n*−1, the third transistor T3_*n*−1, and the fourth transistor T4_*n*−1, which correspond to the n−1th gate line GL_n−1, are turned on. Then, the second transistor T2_*n*−1 corresponding to the n−1th gate line GL_n−1 and the fifth transistor T5_*n*−1 corresponding to the n−1th gate line GL_n−1 are turned off.

Additionally, the first transistor T1_*n*, the third transistor T3_*n*, and the fourth transistor T4_*n*, which correspond to the nth gate line GL_n, are turned on. Then, the second transistor T2_*n* corresponding to the nth gate line GL_n and the fifth transistor T5_*n* corresponding to the nth gate line GL_n are turned off.

In the same manner, the first transistor T1_*n*+1, the third transistor T3_*n*+1, and the fourth transistor T4_*n*+1, which correspond to the n+1th gate line GL_n+1, are turned on. Then, the second transistor T2_*n*+1 corresponding to the n+1th gate line GL_n+1 and the fifth transistor T5_*n*+1 corresponding to the n+1th gate line GL_n+1 are turned off.

In the second section T1 to T2, the plurality of modulation voltages VM_n−1, VM_n, and VM_n+1 for simultaneously programming the plurality of memory transistors MT_n−1, MT_n, and MT_n+1 that respectively correspond to the plurality of gate lines GL_n−1, GL_n, and GL_n+1 are applied to the gate of each memory transistor. For example, the plurality of modulation voltages VM_n−1, VM_n, and VM_n+1 have the first voltage level V_PGM.

In the second section T1 to T2, when the plurality of memory transistors MT_n−1, MT_n, and MT_n+1 are programmed, the gate-drain characteristics VGS-IDS of the plurality of memory transistors MT_n−1, MT_n, and MT_n+1 become the first state S1 from the second state S2 of FIG. 5.

In the second section T1 to T2, after the plurality of memory transistors MT_n−1, MT_n, and MT_n+1 are programmed, a level of the plurality of memory transistors MT_n−1, MT_n, and MT_n+1 is maintained as the second voltage level V_RO in the first voltage level V_PGM. In this case, the first capacitors C1_*n*−1, C1_*n*, and C1_*n*+1 corresponding to the plurality of gate lines GL_n−1, GL_n, and GL_n+1 respectively are charged in the second voltage level V_RO. For example, the second voltage level V_RO is a voltage that is lower than the first voltage level V_PGM and turns on the plurality of memory transistors MT_n−1, MT_n, and MT_n+1.

In the second section T1 to T2, the second capacitors C2_*n*−1, C2_*n*, and C2_*n*+1 corresponding to the plurality of gate lines GL_n−1, GL_n, and GL_n+1 respectively are charged in the third voltage level V_IL. For example, the third voltage level V_IL may be lower than the second voltage level V_RO and may be a negative voltage level.

In the second section T1 to T2, by using a ground voltage VSS, the fourth transistors T4_*n*−1, T4_*n*, and T4_*n*+1 that respectively correspond to the plurality of gate lines GL_n−1, GL_n, and GL_n+1 may initialize the third nodes N3_*n*−1, N3_*n*, and N3_*n*+1 that respectively correspond to the plurality of gate lines GL_n−1, GL_n, and GL_n+1.

In the second section T1 to T2, the plurality of modulation voltages VM_n−1, VM_n, and VM_n+1 having the second voltage level V_RO for turning on the plurality of memory transistors MT_n−1, MT_n, and MT_n+1 are applied to the gates of the plurality of memory transistors MT_n−1, MT_n, and MT_n+1. Accordingly, the plurality of light emitting control lines EL_n−1, EL_n, and EL_n+1 output the first power voltage EL_H as light emitting control signals.

The following drawings illustrate a process for outputting a light emitting control signal to an nth light emitting line based on the first to sixth transistors T1_*n* to T6_*n*, the first and second capacitors C1_*n* and C2_*n*, and the memory transistors MT_n, which correspond to the nth gate line GL_n.

Figure 8:
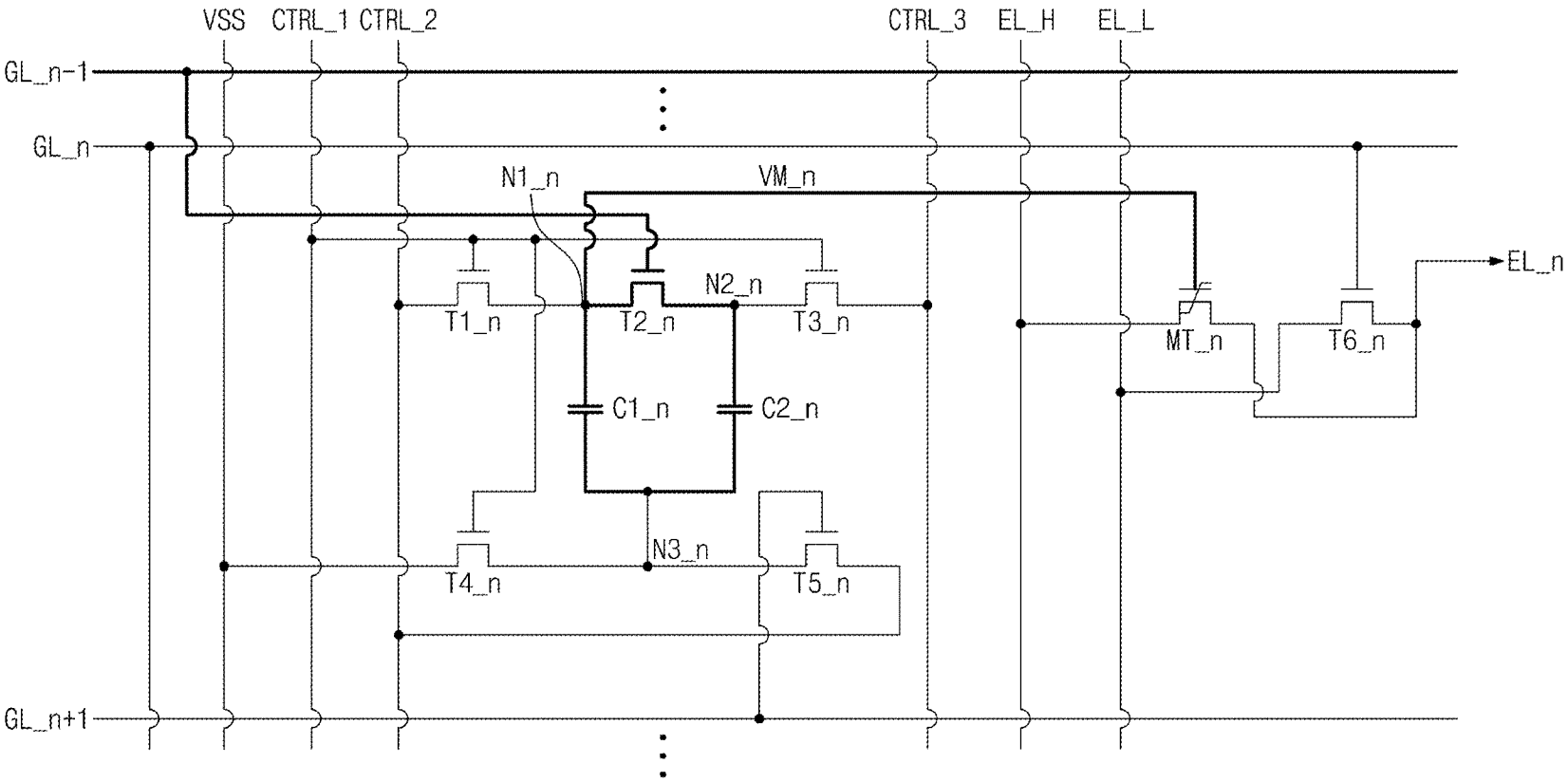
FIG. 8 is a circuit diagram illustrating an operation of a gate driving circuit in a section T3 to T4 of FIG. 6.

FIG. 8 is a circuit diagram illustrating an operation of a gate driving circuit in the fourth section T3 to T4 of FIG. 6. When the fourth section T3 to T4 of FIG. 8 is described, lines indicated by the solid line represent that signals in high level are applied. Additionally, devices displayed by the solid line represent devices activated in the fourth section T3 to T4.

Referring to FIGS. 1 to 8, in the fourth section T3 to T4, a gate signal of the n−1th gate line GL_n−1 has a high level. Accordingly, the second transistor T2_*n* is turned on. When the second transistor T2_*n* is turned on, the remaining transistors are turned off.

Accordingly, in the fourth section T3 to T4, the first capacitor C1_*n*, the second capacitor C2_*n*, and the second transistor T2_*n* constitute one closed circuit. On the basis of the law of charge conservation, a second voltage level V_RO of the nth modulation voltage VM_n corresponding to the first capacitor C1_*n* is modulated to the fourth voltage level V_RoM. In the same manner, a third voltage level V_IL corresponding to the second capacitor C2_*n* is modulated to the fourth voltage level V_RoM. In this case, the fourth voltage level V_RoM may be lower than the second voltage level V_RO and may be higher than the third voltage level V_IL. Accordingly, in the fourth section T3 to T4, the memory transistor MT_n is turned off. In the same manner, since the sixth transistor T6_*n* is turned off, in the fourth section T3 to T4, a light emitting control signal of the nth light emitting line EL_n may have an undefined floating value. However, the fourth section T3 to T4 corresponds to a very short time compared to the entire time of one frame and an undefined light emitting control signal in this section does not affect the entire screen quality of a display device greatly.

Figure 9:
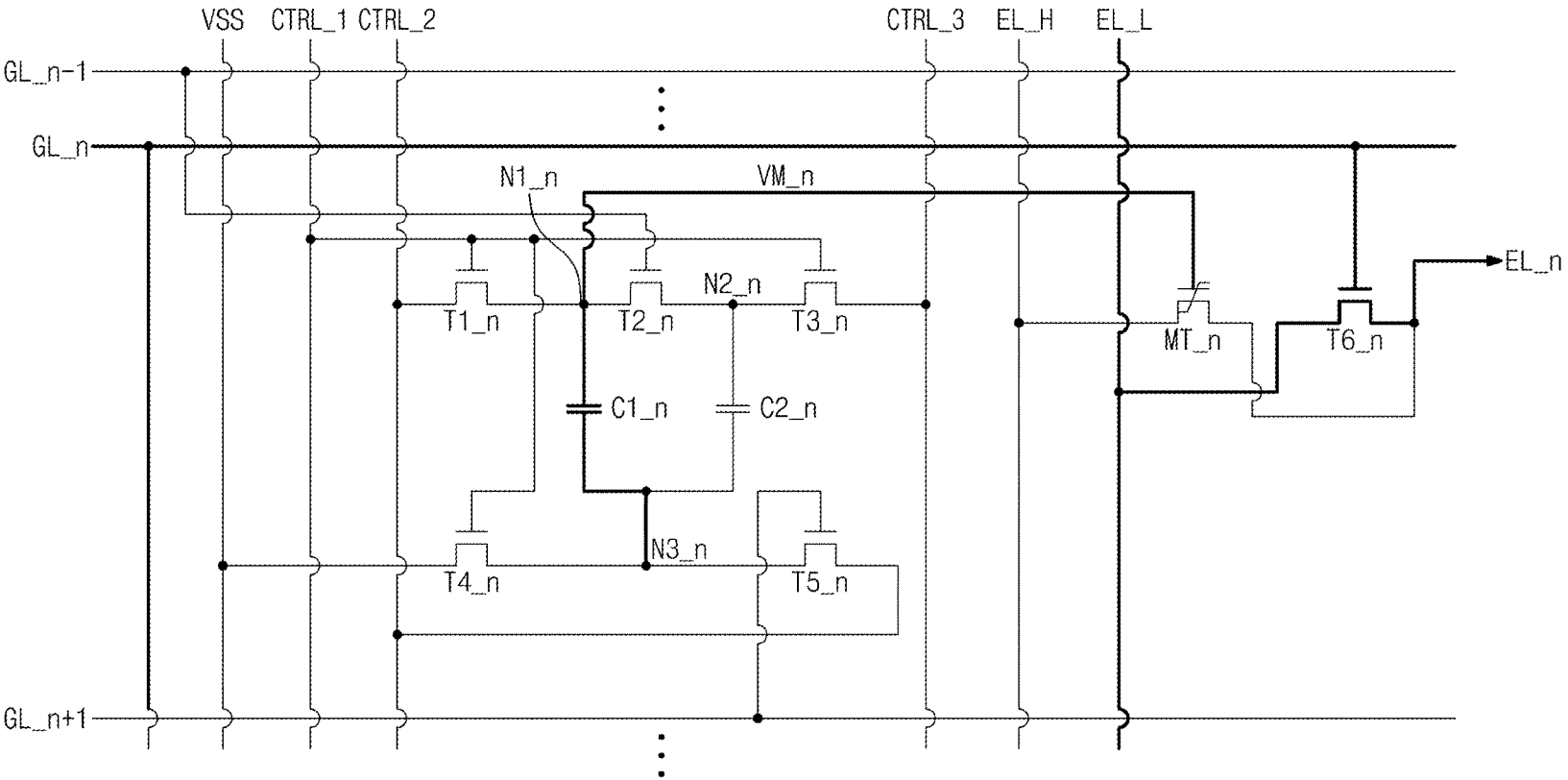
FIG. 9 is a circuit diagram illustrating an operation of a gate driving circuit in a section T4 to T5 of FIG. 6.

FIG. 9 is a circuit diagram illustrating an operation of a gate driving circuit in the fifth section T4 to T5 of FIG. 6. When the fifth section T4 to T5 of FIG. 9 is described, lines indicated by the solid line represent that signals in high level are applied. Additionally, devices displayed by the solid line represent devices activated in the fifth section T4 to T5.

Referring to FIGS. 1 to 9, in the fifth section T4 to T5, a gate signal of the nth gate line GL_n has a high level. Accordingly, the sixth transistor T6_*n* is turned on. In this case, since the nth modulation voltage VM_N maintains the fourth voltage level V_RoM, the memory transistor MT_n maintains a turn-off state. Therefore, the sixth transistor T6_*n* may output the second power voltage EL_L as a light emitting control signal of the nth light emitting line EL_n.

Figure 10:
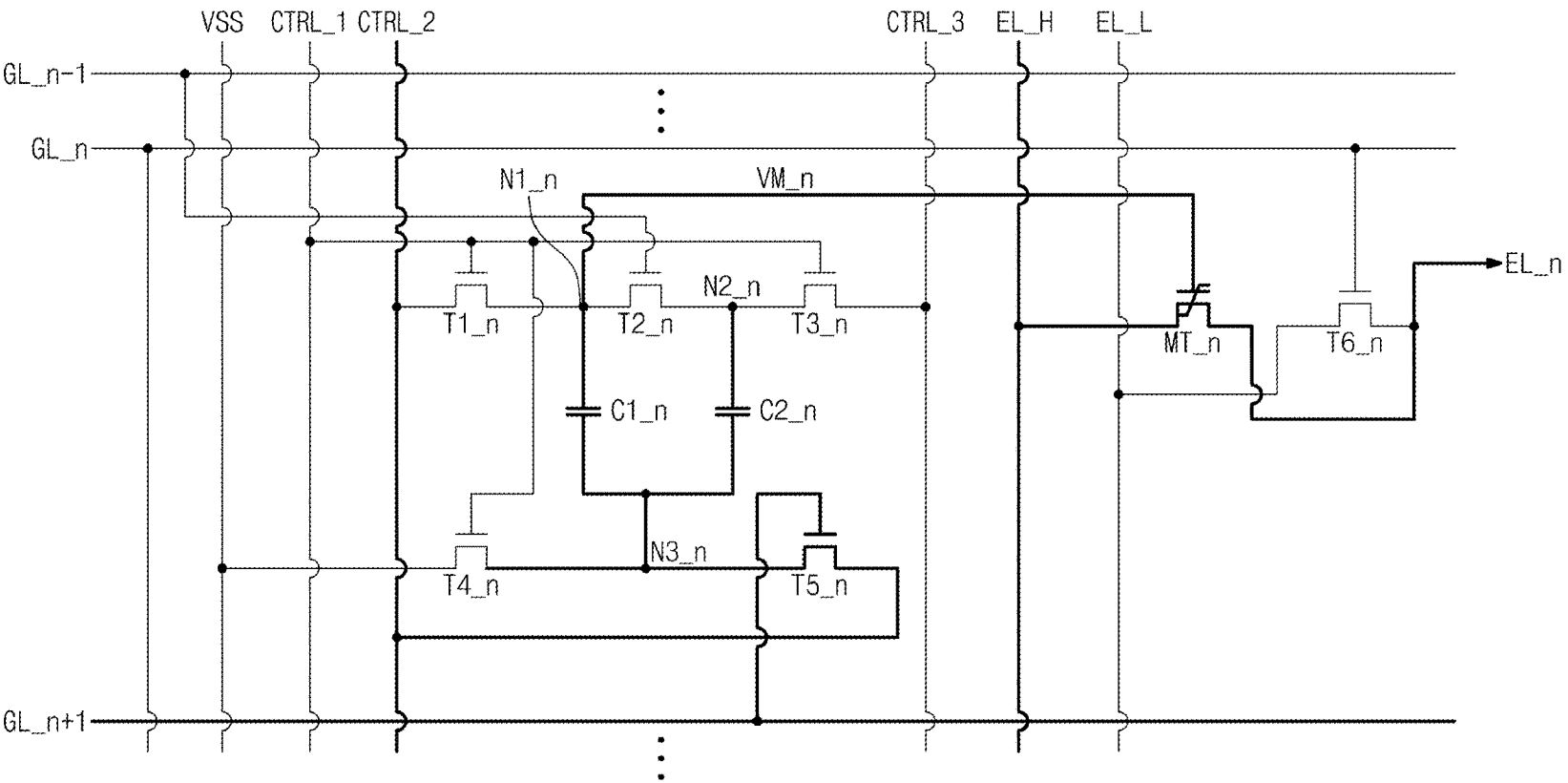
FIG. 10 is a circuit diagram illustrating an operation of a gate driving circuit in a section T5 to T6 of FIG. 6.

FIG. 10 is a circuit diagram illustrating an operation of a gate driving circuit in the sixth section T5 to T6 of FIG. 6. When the sixth section T5 to T6 of FIG. 10 is described, lines indicated by the solid line represent that signals in high level are applied. Additionally, devices displayed by the solid line represent devices activated in the sixth section T5 to T6.

Referring to FIGS. 1 to 10, in the sixth section T5 to T6, a gate signal of the n+1th gate line GL_n+1 has a high level.

As mentioned above, when the first capacitor C1_*n* is charged in the second voltage level V_RO, a voltage level of the second control signal CTRL_2 maintains the boost level V_BST.

When a high level of gate signal is applied to the n+1th gate line GL_n+1 as shown in FIG. 10, the fifth transistor T5_*n* is turned on and the second control signal CTRL_2 having the boost level V_BST is applied to the third node N3_*n*. Accordingly, charging voltages of the first capacitor C1_*n* and the second capacitor C2_*n* rise by the second control signal CTRL_2 having the boost level V_BST. Accordingly, a voltage level of the nth modulation voltage VM_n may be adjusted to have the second voltage level V_RO again from the fourth voltage level V_RoM.

In the sixth section T5 to T6, the nth modulation voltage VM_n has the second voltage level V_RO again. Accordingly, the memory transistor MT_n is turned on. Therefore, the memory transistor MT_n may output the first power voltage EL_H as a light emitting control signal of the nth light emitting line EL_n again.

A driving circuit according to an embodiment of the inventive concept and an OLED device including the same may operate appropriately under an operating environment that requires a fast operation on a memory transistor by modulating the size of a read-out voltage of a memory transistor having a non-volatile property. Furthermore, a driving circuit according to an embodiment of the inventive concept and an OLED device including the same may operate based on a smaller number of transistors than the number of transistors included in a conventional gate driving circuit. Accordingly, a driving circuit according to an embodiment of the inventive concept and an OLED device including the same may be advantageous to the minimization of a device. Furthermore, a driving circuit according to an embodiment of the inventive concept and an OLED device including the same may consume less power compared to using a conventional gate driving circuit.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A gate driving circuit comprising an ith modulation circuit connected to an i−1th gate line and an i+1th gate line (where i is a natural number greater than 1) and an ith line selection circuit connected to an ith gate line and an ith light emitting line, wherein the ith modulation circuit outputs an ith modulation voltage to the ith line selection circuit based on first to third control signals and comprises first to fifth transistors and first and second capacitors, and wherein the ith line selection circuit comprises a memory transistor that is turned on or turned off according to a level of the ith modulation voltage received from the ith modulation circuit.

2. The gate driving circuit of claim 1, wherein in the ith modulation circuit, an intersection point of a first end of the first transistor and a first end of the second transistor is a first node, an intersection point of a second end of the second transistor and a first end of the third transistor is a second node, an intersection point of a first end of the fourth transistor and a first end of the fifth transistor is a third node, the first capacitor is connected between the first node and the third node, and the second capacitor is connected between the second node and the third node.

3. The gate driving circuit of claim 2, wherein a gate of the first transistor receives the first control signal, a second end of the first transistor receives the second control signal, and the first end of the first transistor is connected to the first node, wherein a gate of the second transistor is connected to the i−1th gate line, the first end of the second transistor is connected to the first node, and the second end of the second transistor is connected to the second node, wherein a gate of the third transistor receives the first control signal, the second end of the third transistor receives the third control signal, and the first end of the third transistor is connected to the second node, wherein a gate of the fourth transistor receives the first control signal, a second end of the fourth transistor is connected to a ground voltage, and the first end of the fourth transistor is connected to the third node, wherein a gate of the fifth transistor is connected to the i+1th gate line, a second end of the fifth transistor receives the second control signal, and the first end of the fifth transistor is connected to the third node.

4. The gate driving circuit of claim 3, wherein the first to fifth transistors are Oxide-Thin-Film-Transistors, and a capacitance of the second capacitor is greater than a capacitance of the first capacitor.

5. The gate driving circuit of claim 1, wherein the ith line selection circuit further comprises a sixth transistor, wherein a gate of the memory transistor receives the ith modulation voltage, a first end of the memory transistor is connected to a first power voltage, and a second end of the memory transistor is connected to the ith light emitting line, wherein a gate of the sixth transistor is connected to the ith gate line, a first end of the sixth transistor is connected to a second power voltage having a lower level than the first power voltage, and a second end of the sixth transistor is connected to the ith light emitting line.

6. The gate driving circuit of claim 5, wherein the memory transistor has non-volatile data retention characteristics and the sixth transistor is an Oxide-Thin-Film-Transistor.

7. The gate driving circuit of claim 5, wherein while the first control signal maintains a high level, the second control signal having a first voltage level for programming the memory transistor is applied to the gate of the memory transistor as the ith modulation voltage.

8. The gate driving circuit of claim 7, wherein after the memory transistor is programmed, a level of the ith modulation voltage is maintained in a second voltage level, the first capacitor is charged in the second voltage level; and the second voltage level is lower than the first voltage level and turns on the memory transistor.

9. The gate driving circuit of claim 8, wherein the second capacitor is charged by a third control signal having a third voltage level, and the third voltage level is lower than the second voltage level and is a negative voltage level.

10. The gate driving circuit of claim 9, wherein when a high level of gate signal is delivered to the i−1th gate line, the second transistor is turned on, wherein a level of a voltage of the first capacitor and a level of a voltage of the second capacitor are adjusted to have a fourth voltage level, and wherein the fourth voltage level is lower than the second voltage level and is higher than the third voltage level and turns off the memory transistor.

11. The gate driving circuit of claim 10, wherein when a high level of gate signal is delivered to the ith gate line, the sixth transistor is turned on, wherein the sixth transistor outputs the second power voltage to the ith light emitting line.

12. The gate driving circuit of claim 11, wherein after a level of a voltage of the first capacitor is adjusted to the second voltage level, a voltage level of the second control signal is maintained in a boost level, wherein while a high level of gate signal is applied to the i+1th gate line, the fifth transistor is turned on and the second control signal having the boost level is applied to the third node.

13. The gate driving circuit of claim 12, wherein a level of a voltage of the first capacitor and a level of a voltage of the second capacitor are adjusted to have the second voltage level by the second control signal having the boost level.

14. The gate driving circuit of claim 10, wherein a level of a voltage of the first capacitor and a level of a voltage of the second capacitor are adjusted to have the fourth voltage level through charge sharing.

15. An organic light emitting display device comprising:

a gate driving circuit configured to provide gate signals to gate lines and provide light emitting control signals to light emitting lines;

a data driving circuit configured to provide data signals to data lines; and organic light emitting display panels comprising a plurality of pixels, wherein the gate driving circuit comprises an ith modulation circuit connected to an i−1th gate line and an i+1th gate line (where i is a natural number greater than 1) and an ith line selection circuit connected to an ith gate line and an ith light emitting line, wherein the ith modulation circuit outputs an ith modulation voltage to the ith line selection circuit based on first to third control signals, and wherein the ith line selection circuit comprises a memory transistor that is turned on or turned off according to a level of the ith modulation voltage received from the ith modulation circuit.

16. A method of driving a gate driving circuit the method comprising:

programming a plurality of memory transistors by providing modulation voltages having a first voltage level to gates of the plurality the memory transistors;

turning on the plurality of the memory transistors by dropping the modulation voltages to a second voltage level lower than the first voltage level;

turning off an ith memory transistor by dropping an ith modulation voltage to a third voltage level lower than the second voltage level when a high level of gate signal is delivered to an i−1th gate line (where i is a natural number greater than 1); and turning on the ith memory transistor by rising the ith modulation voltage from the third voltage level to the second voltage level based on a level of an i+1th gate line when a high level of gate signal is delivered to the i+1th gate line.

17. The method of claim 16, wherein the programming a plurality of memory transistors comprises:

turning on a plurality of first transistors based on a first control signal; and receiving a second control signal by input electrodes of the plurality of first transistors, wherein the gates of the plurality of memory transistors connected to output electrodes of the plurality of first transistors, the output electrode of the first transistor is connected to an input electrode of a second transistor, and the i−1th gate line is connected to a gate of an ith second transistor.

18. The method of claim 17, wherein the turning on the plurality of memory transistors comprises:

adjusting a level of a first capacitor to the second voltage level based on the first and second control signals; and adjusting a level of a second capacitor to a negative voltage level based on the first control signal and a third control signal, wherein a first end of the first capacitor is connected to the input electrode of the second transistor, a first end of the second capacitor is connected to an output electrode of the second transistor, and a second end of the first capacitor is connected to a second end of the second capacitor.

19. The method of claim 18, wherein the turning off the ith memory transistor comprises adjusting a level of the first capacitor and a level of the second capacitor to the third voltage level through charge sharing based on the high level of gate signal delivered to the i−1th gate line.

20. The method of claim 19, wherein the turning on the ith memory transistor comprises boosting the level of the first capacitor and the level of the second capacitor based on the high level of gate signal delivered to the i+1th gate line.

* * * * *